US005263789A

United States Patent [19]

Torntore et al.

[11] Patent Number: 5,263,789

[45] Date of Patent: Nov. 23, 1993

[54] LINE STRIPER ACCESSORY

[75] Inventors: Anthony J. Torntore, Bloomington; James K. Barnett, Cottage Grove, both of Minn.

[73] Assignee: Wagner Spray Tech Corporation, Minneapolis, Minn.

[21] Appl. No.: 844,834

[22] Filed: Mar. 3, 1992

[51] Int. Cl.[5] ..... E01C 23/16

[52] U.S. Cl. ..... 404/93; 404/94

[58] Field of Search ..... 404/94, 93; 239/150

[56] References Cited

U.S. PATENT DOCUMENTS 3,352,283 11/1967 Maus ..... 404/94 X 4,624,602 11/1986 Kieffer et al. ..... 404/94

4,877,348 10/1989 Opie ..... 404/94 X 4,893,751 1/1990 Armstrong ..... 404/94 X

*Primary Examiner*—William P. Neuder

*Attorney, Agent, or Firm*—Faegre & Benson

[57] ABSTRACT

A line striper accessory for combining with a conventional paint sprayer mounted on a wheeled cart utilizing the cart wheels and a castor assembly to support the combined cart and line striping accessory. The accessory includes handlebars having actuators to selectively actuate a locking mechanism and the spray gun mounted on the accessory for providing paint stripes on the surface over which the striper is rolled.

9 Claims, 5 Drawing Sheets

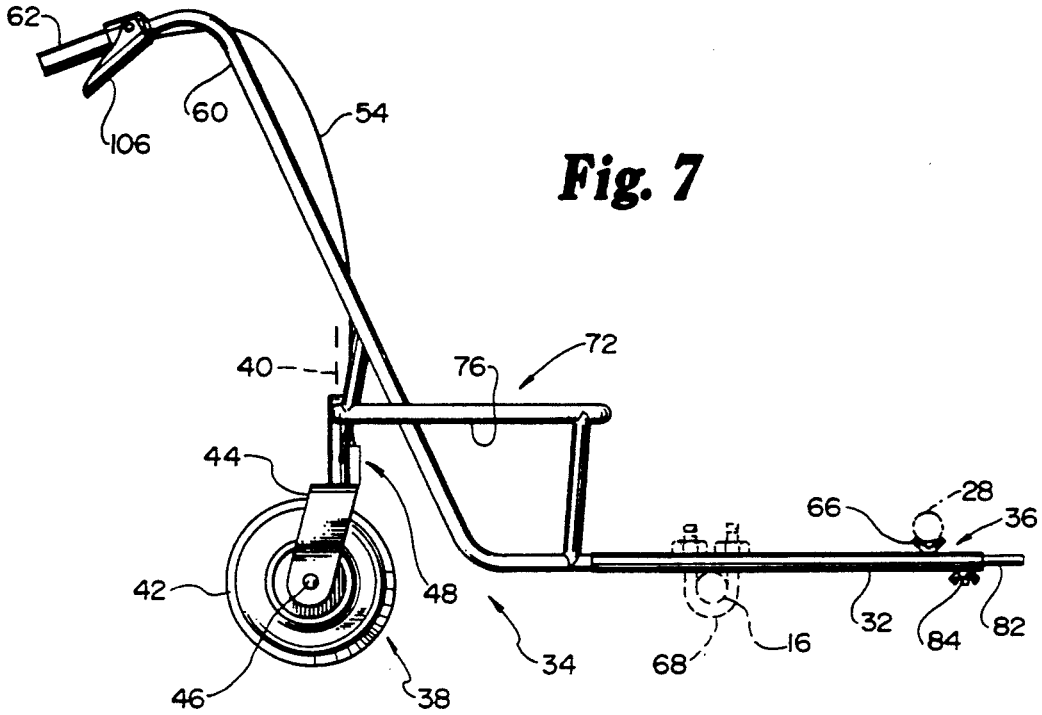
Fig. 7
Fig. 8
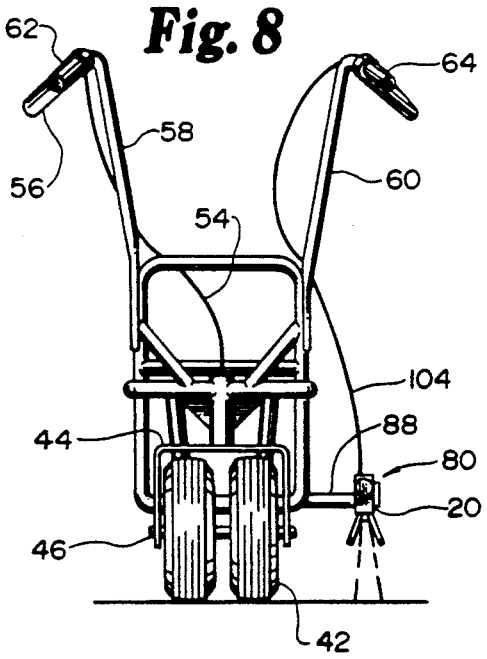
Fig. 9
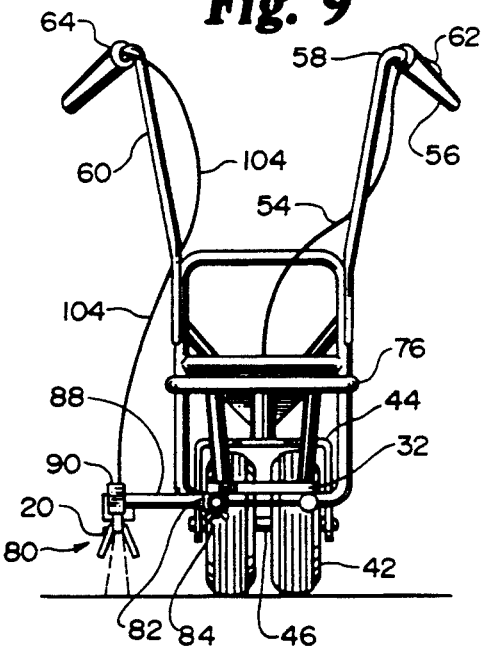

LINE STRIPER ACCESSORY

FIELD OF THE INVENTION

This invention relates to the field of portable paint spraying equipment, more particularly to equipment suitable for spraying lines on parking lots and the like.

BRIEF DESCRIPTION OF THE DRAWINGS

FIG. 7 is a right-hand side elevation view of the line striper accessory.

FIG. 8 is a rear elevation view of the line striper accessory with spray gun attached for line striping duty.

FIG. 9 is a front elevation view of the line striper accessory of FIG. 8.

DETAILED DESCRIPTION

Figure 1:
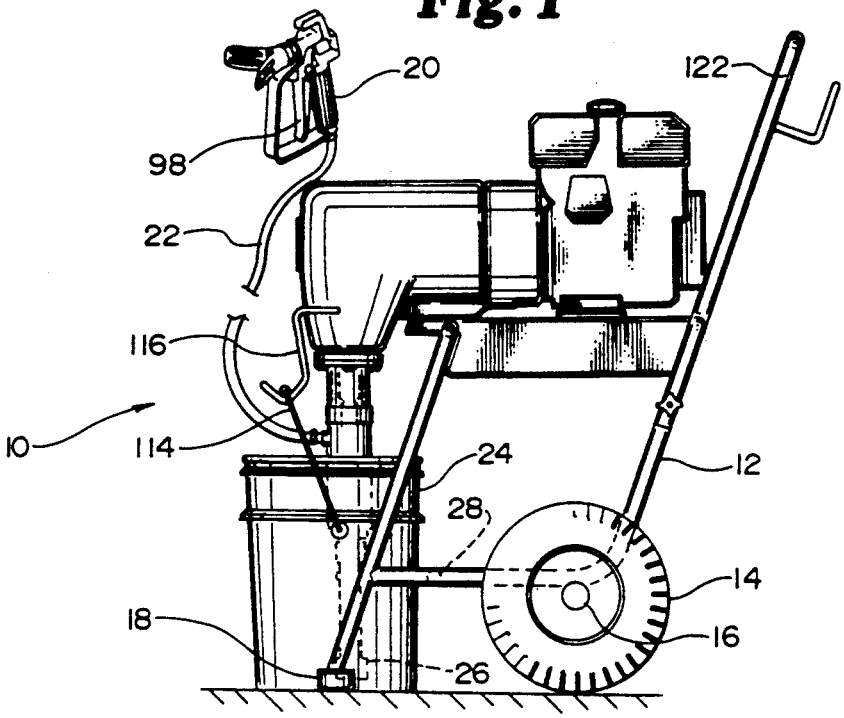
FIG. 1 is a left-side elevation view of a portable paint spraying apparatus in a non-line-striping configuration.

Referring now to the figures, and most particularly to FIG. 1, a portable paint sprayer 10 may be seen. Sprayer 10 preferably includes a cart 12, having a pair of wheels 14 spaced apart (see FIG. 3). Wheels 14 are preferably carried by an axle 16. In a conventional painting configuration such as shown in FIG. 1, cart 12 also rests on a pair of legs 18. In this configuration, a spray gun 20 is supplied with paint via hose 22, but is otherwise unrestrained so as to permit operator to grasp gun 20 and move it to apply paint as desired. In the configuration shown in FIG. 1, paint is drawn from a bucket 24 via a paint pump intake 26.

Figure 3:
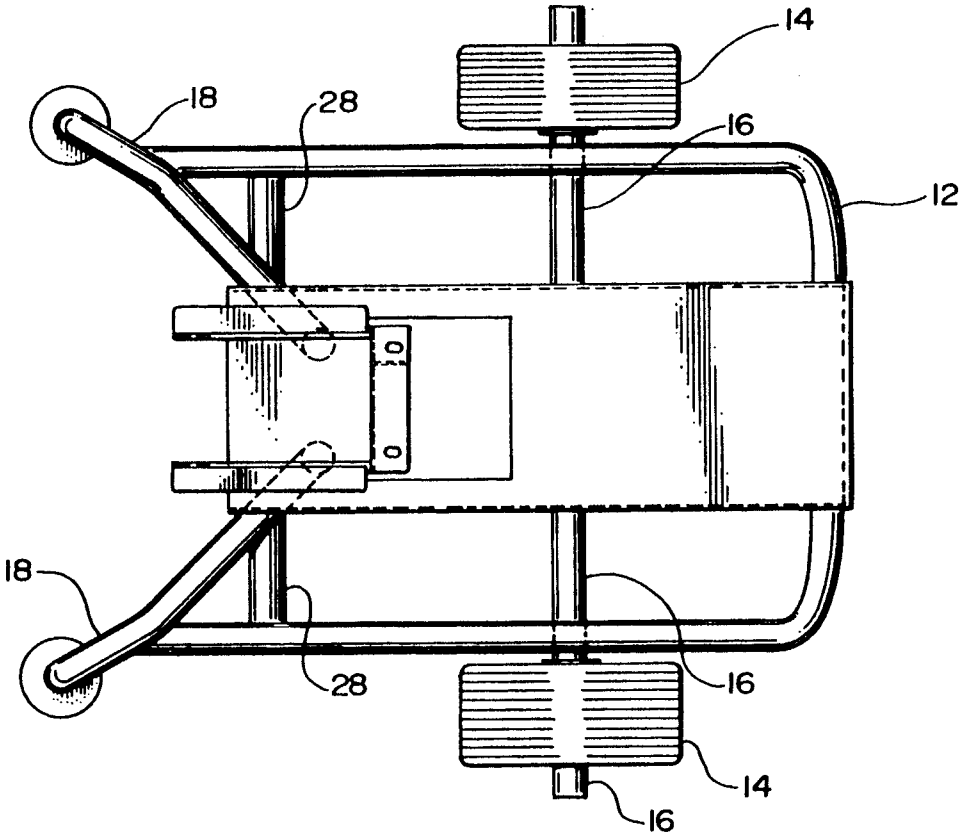
FIG. 3 is a simplified top plan view of a portion of the cart of FIG. 1.

Referring now also to FIG. 3, cart 12 preferably also has a transverse support 28 extending parallel to axle 16.

Figure 2:
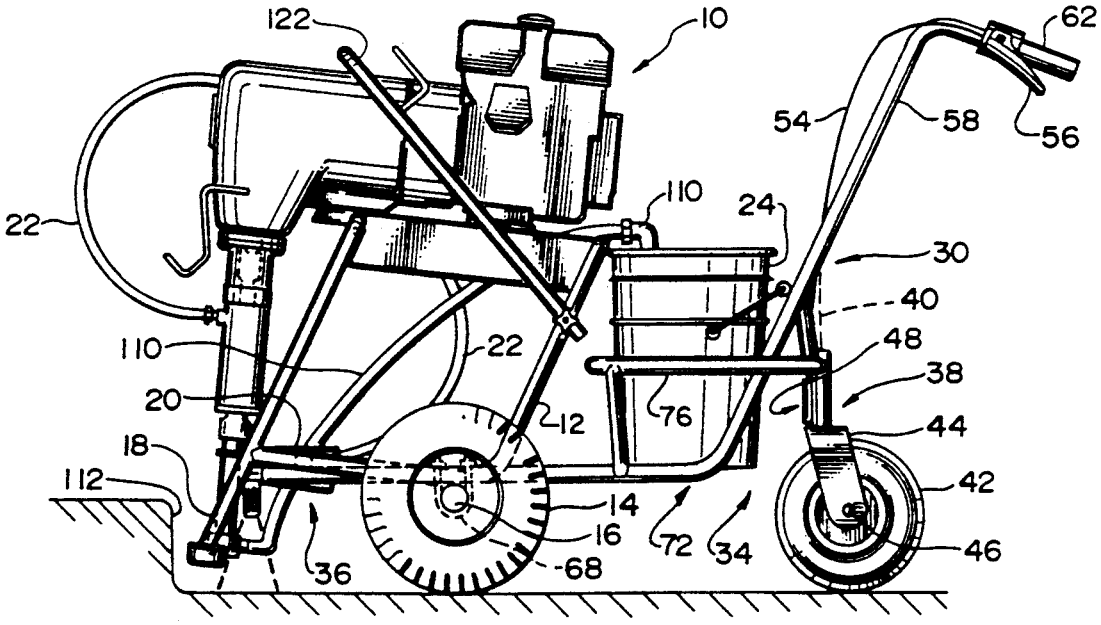
FIG. 2 is a left-side elevation view of the portable paint sprayer apparatus of FIG. 1 coupled to a line sprayer accessory and arranged in a line-striping configuration.
Figure 4:
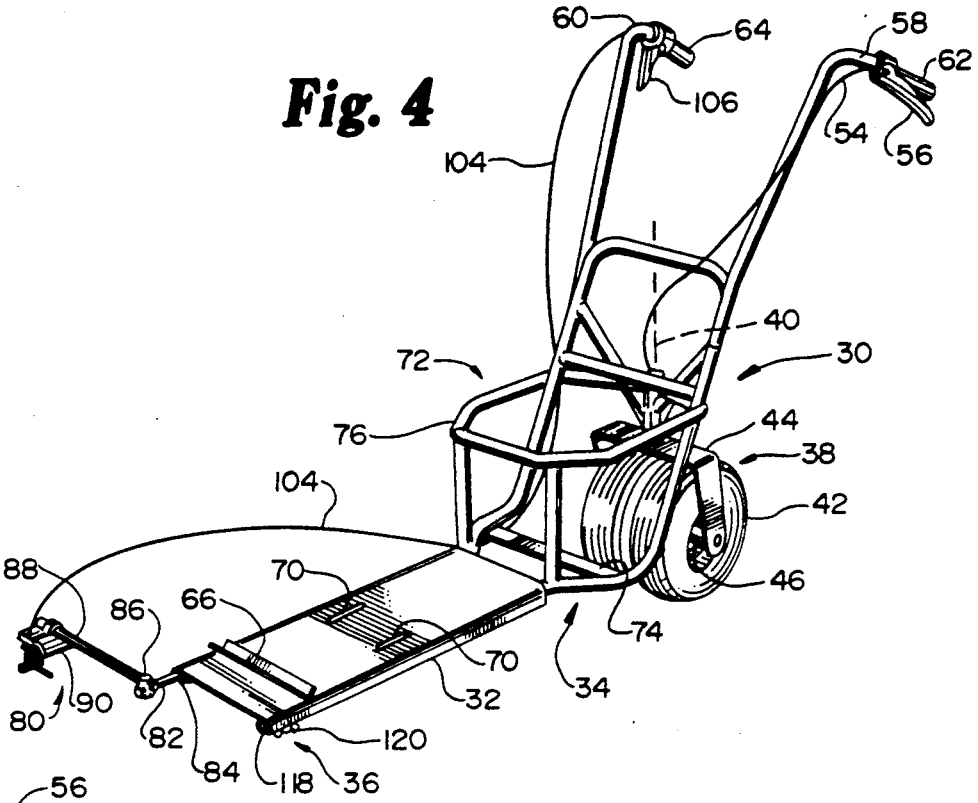
FIG. 4 is a perspective view of the line striper accessory suitable for use with the paint sprayer of FIG. 1.
Figure 5:
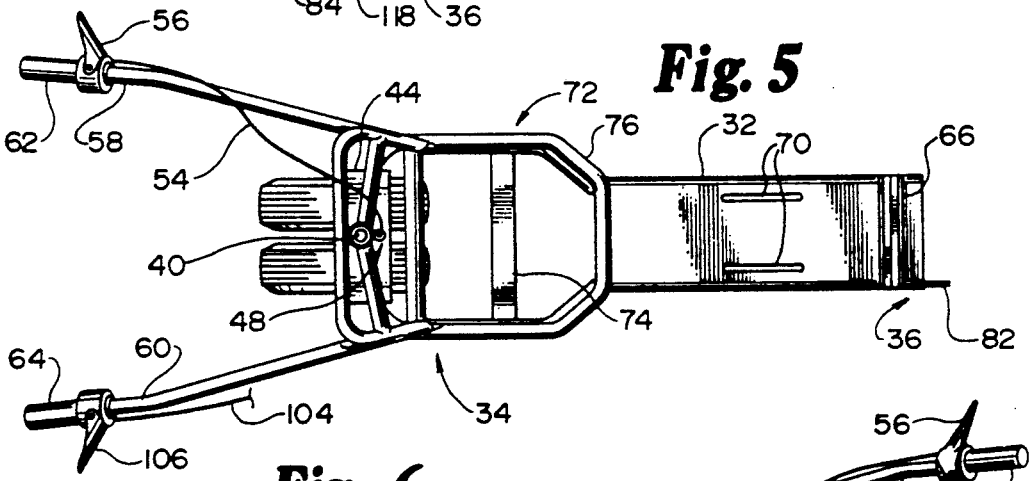
FIG. 5 is a top plan view of the line striper accessory.
Figure 6:
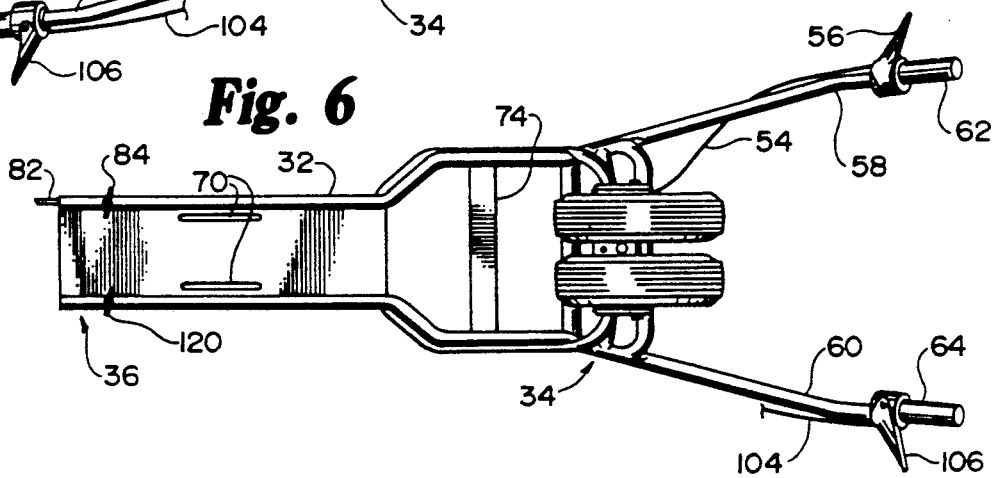
FIG. 6 is a bottom plan view of the line striper accessory.

Referring now most particularly to FIGS. 2 and 4, a line striper accessory 30 may be seen.

Figure 10:
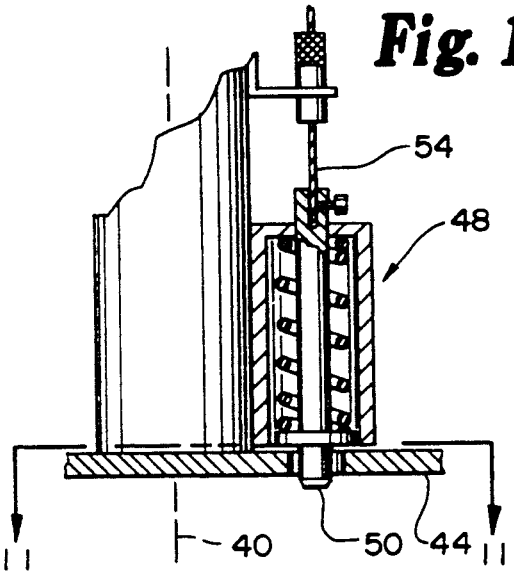
FIG. 10 is a detailed view of a locking mechanism for the castor assembly of the present invention.
Figure 11:
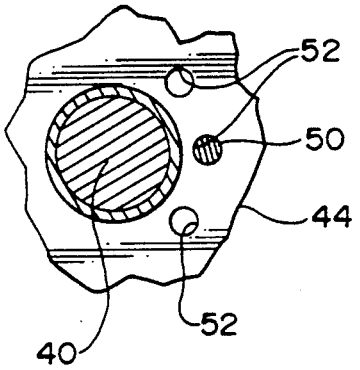
FIG. 11 is a fragmentary section view taken along 11—11 of FIG. 10.

Line striper 30 preferably includes an elongated support frame 32 having a first end 34 and a second end 36. Accessory 30 also has a castor assembly 38 located at the first end 34 of frame 32. Castor assembly has a vertical castor axis 40 about which castor assembly 38 may swivel. Assembly 38 has at least one and preferably two wheels 42 mounted in a yoke 44. Wheels 42 preferably have a horizontal axle 46. The line striper 30 also preferably has a locking mechanism 48 (see FIGS. 10 and 11) which is operable to a first position (as shown in FIGS. 10 and 11) to prevent swiveling the castor assembly when the castor wheel axle 46 is transverse to frame 32. Locking mechanism 48 is movable to alternate locking positions to position the castor assembly 38 to provide a fixed turning radius for the line striper 30. In the first position, a spring biased releasable pin 50 located on frame 32 is engageable with one of a plurality of apertures 52 in yoke 44. In the second position of locking mechanism 48, pin 50 is retracted or disengaged from yoke 44. Pin 50 is actuated by a flexible cable 54 connected to a hand grip actuator for selectively activating the locking mechanism 48. Line or paint striper 30 also preferably has handlebars 58, 60 which include hand grips 62, 64. It is to be understood that handlebars 58, 60 extend from frame 32 to grips 62, 64 to permit an operator to grasp and propel the line striper 30.

Line striper 30 also has cart securing means positioned along the frame 32 for securing the cart 12 to the frame such that the combined cart and frame (as shown in FIG. 2) is supported by wheels 14 of the cart 12 and the castor assembly 38. In particular, the cart securing means includes a first supporting means in the form of a V-shaped channel 66. Channel 66 supports transverse member 28 of cart 12 on frame 32 proximate the second end 36 of frame 32. The cart securing means also includes a second supporting means for supporting the frame 32 on the cart 12 (more particularly on axle 16) intermediate the first and second ends 34, 36 of frame 32. A pair of U-clamps 68 may be received around axle 16 and secured to slots 70 in frame 32.

Line striper accessory 30 also preferably has a receptacle portion 72 adapted to hold paint bucket 24. Receptacle 72 is made up of a transverse base plate 74 and a surrounding frame 76.

Figure 12:
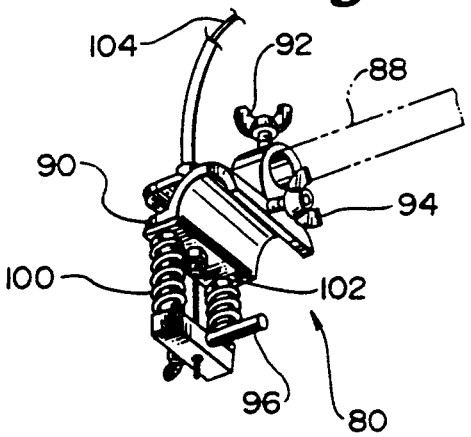
FIG. 12 is a detailed view of the paint gun clamp and actuator seen from below.

Line striper 30 also preferably includes a spray gun mounting apparatus 80 as is shown most clearly in FIGS. 4 and 12. Apparatus 80 includes a first tubular extension 82 which may be secured to frame 32 via a thumb screw 84. A right angle clamp 86 joins a second extension 88 to first extension 82. A gun mounting block 90 is preferably mounted to second extension 88 and secured thereto via a thumb screw 92. A further thumb screw 94 may be used to clamp gun 20 in block 90. A transverse projecting finger 96 engages a trigger 98 in gun 20 when gun 20 is mounted in block 90. Finger 96 is biased to the position shown in FIG. 12 via a pair of springs 100, 102 and is selectively capable of being retracted towards block 90 via flexible cable 104. As may be seen most clearly in FIG. 4, cable 104 is actuatable via a handlebar actuator 106 when it is desired to stripe paint by actuating gun 20.

Referring now again to FIG. 2, it may be seen that an extended suction set 110 may be used to draw paint from bucket 24 when the combination of sprayer 10 and accessory 30 is configured for line striping. This permits a close approach to a curb 112 which would not be possible with the paint bucket 24 in the configuration shown in FIG. 1, even though such configuration would be possible for striping because bucket 24 is supported by bail 114 on hook 116 when the sprayer 10 is elevated as shown in FIG. 2. In other words, if it is not required to have a close approach to curb 112, direct suction of paint may be utilized, as indicated in FIG. 1, even while sprayer 10 is configured on striper 30 as shown in FIG. 2.

It is also to be understood that additional spray guns may be mounted on apparatus 80 to spray parallel lines or, alternatively, one or more additional spray guns may be mounted on a second apparatus (not shown) which would extend from alternate extension 118 (see FIG. 4) which is secured by thumb screw 120. In FIG. 4, extension 118 is shown in a storage position or configuration.

It is also to be understood that it is preferable, although not necessary, to rotate handle 122 of sprayer 10 from the position shown in FIG. 1 to that of FIG. 2 to permit ready access to the receptacle portion 72 when it is desired to insert a bucket, add paint or solvent, or remove bucket 24.

The invention is not to be taken as limited to all of the details thereof as modifications and variations thereof may be made without departing from the spirit or scope of the invention.

What is claimed is:

1. A line striper apparatus comprising:

a) portable paint sprayer having i) a portable paint sprayer cart supported at a first end by a pair of paint sprayer cart wheels and at a second end by at least one leg, ii) pump means for pumping paint mounted on the portable paint sprayer cart, and iii) a paint spray gun fed with paint by the pump means; and b) a line striper accessory having i) an elongated support frame having first and second ends;

ii) a castor assembly mounted at the first end of the support frame and having a vertical castor axis and at least one wheel having a horizontal axle;

iii) a locking mechanism operable to: 1) a first position to prevent swiveling the castor assembly when the castor wheel axle is transverse to the frame, and 2) a second position to permit swiveling of the castor assembly to permit turning the line striper;

iv) handle bar means secured to and extending from the frame for permitting an operator to grasp and propel the line striper accessory; and v) paint sprayer cart securing means positioned along the elongated support frame distal of the first end detachably securing the portable paint sprayer cart to the frame;

such that when the portable paint sprayer cart is secured to the frame, the combined cart and frame is supported by the paint sprayer cart wheels and the castor assembly, and when the portable paint sprayer cart is not secured to the frame, the portable paint sprayer is useable without the line striper accessory and is supported by the paint sprayer cart wheels and the paint sprayer cart leg.

2. The apparatus of claim 1 wherein the line striper accessory further comprises:

vi) a spray gun support detachably mounting the spray gun generally adjacent the second end of the frame and outboard of the combined frame and cart such that the gun is operable by an operator to spray a surface on which the frame and cart is supported.

3. The apparatus of claim 1 wherein the handlebar means further comprises a first hand grip actuator for selectively operating the spray gun.

4. The apparatus of claim 3 wherein the handlebar means further comprises a second hand grip actuator for selectively operating the locking mechanism.

5. The apparatus of claim 4 wherein the locking mechanism is operable to secure the castor wheel axle at at least one angle other than transverse to the frame.

6. The apparatus of claim 5 wherein the locking mechanism comprises a spring-biased releasable pin located on the frame and engageable with one of a plurality of apertures in a yoke of the castor assembly such that i) the castor assembly is locked against rotation when the pin is received in an aperture of the yoke, and ii) the castor assembly is free to swivel about the vertical axis when the pin is disengaged from the yoke.

7. The apparatus of claim 1 wherein the cart securing means further comprises first supporting means for supporting the cart on the frame proximate the second end of the frame.

8. The apparatus of claim 7 wherein the cart securing means further comprises second supporting means for supporting the frame on the cart intermediate the first and second ends of the frame.

9. The apparatus of claim 8 wherein the second supporting means further comprises clamping means for clamping the cart and frame together.

* * * * *